United States Patent [19]

Kramer et al.

[11] Patent Number: 5,000,206

[45] Date of Patent: Mar. 19, 1991

[54] FLOODWASHING PROCESS AND FLOODWASHER

[75] Inventors: Carl Kramer, Aachen; Karl-Eugen Metzger, Roetgen; Dieter Ahrens, Simmerath-Lammersdorf, all of Fed. Rep. of Germany

[73] Assignee: Duerr GmbH, Stuttgart, Fed. Rep. of Germany

[21] Appl. No.: 244,662

[22] Filed: Sep. 14, 1988

[30] Foreign Application Priority Data

Sep. 18, 1987 [DE] Fed. Rep. of Germany ..... 3731410

[51] Int. Cl.[5] ..... B08B 3/00

[52] U.S. Cl. ..... 134/34; 134/22.1; 134/24; 134/25.1; 134/25.4; 134/140; 134/144; 134/148; 134/199; 134/200

[58] Field of Search ..... 134/25.1, 25.4, 24, 134/22, 34, 199, 200, 148, 140, 144; 210/500, 512, 522

[56] References Cited

U.S. PATENT DOCUMENTS 4,635,666 1/1987 Daley et al. ..... 134/172

*Primary Examiner*—Curtis R. Davis

*Attorney, Agent, or Firm*—Kramer, Brufsky & Cifelli

[57] ABSTRACT

In a floodwater and a process for floodwashing workpieces wherein the workpiece is immersed in a bath of washing liquid and a workpiece surface is acted upon by at least one jet of washing liquid issuing from a nozzle, in order to achieve optimum cleaning efficiency of the jets with as low pumping capacity as possible, it is proposed that a free jet be used as jet and that the nozzle be guided at a distance from the workpiece surface which at most is approximately twice the length of the jet core of the free jet.

36 Claims, 3 Drawing Sheets

Figure 1:
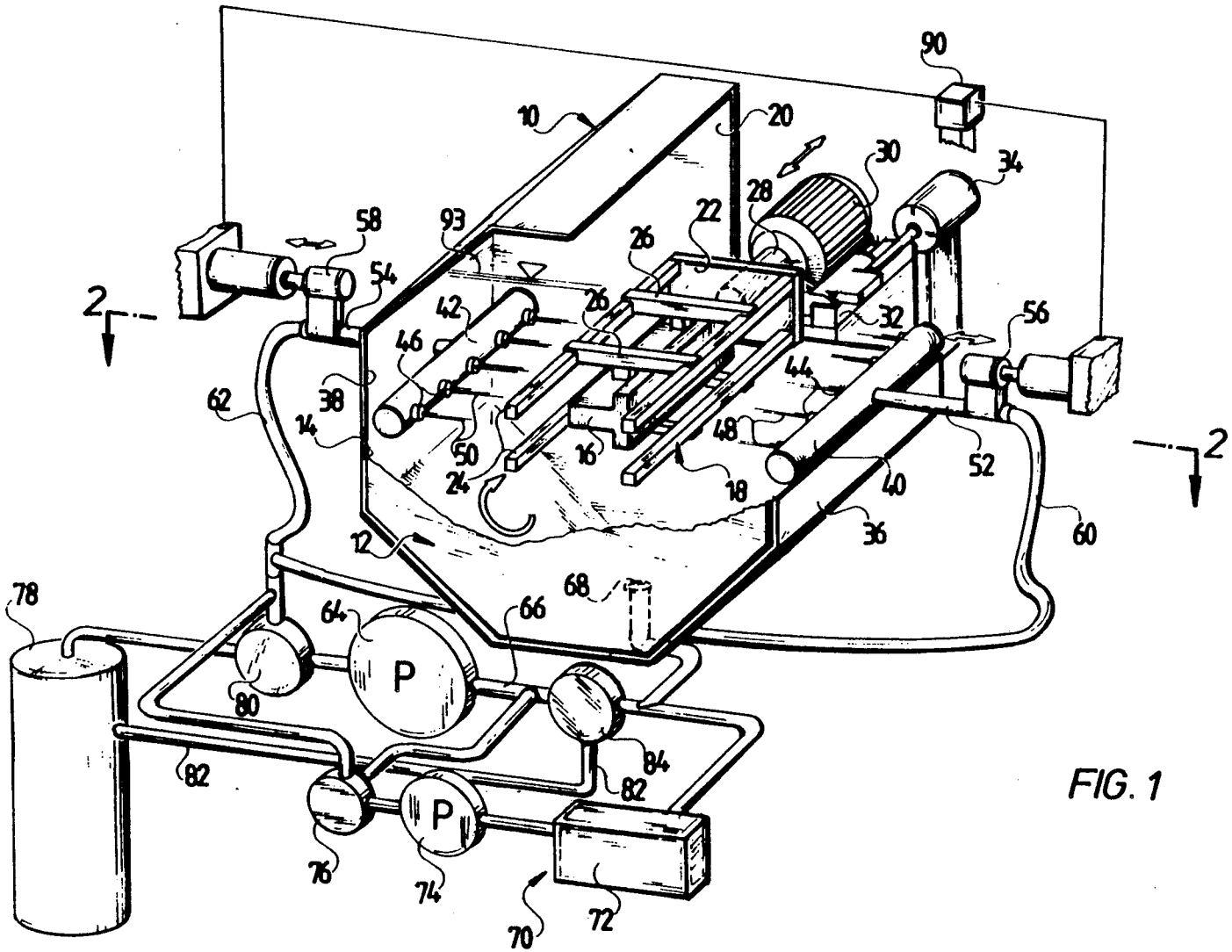

FIG. 2
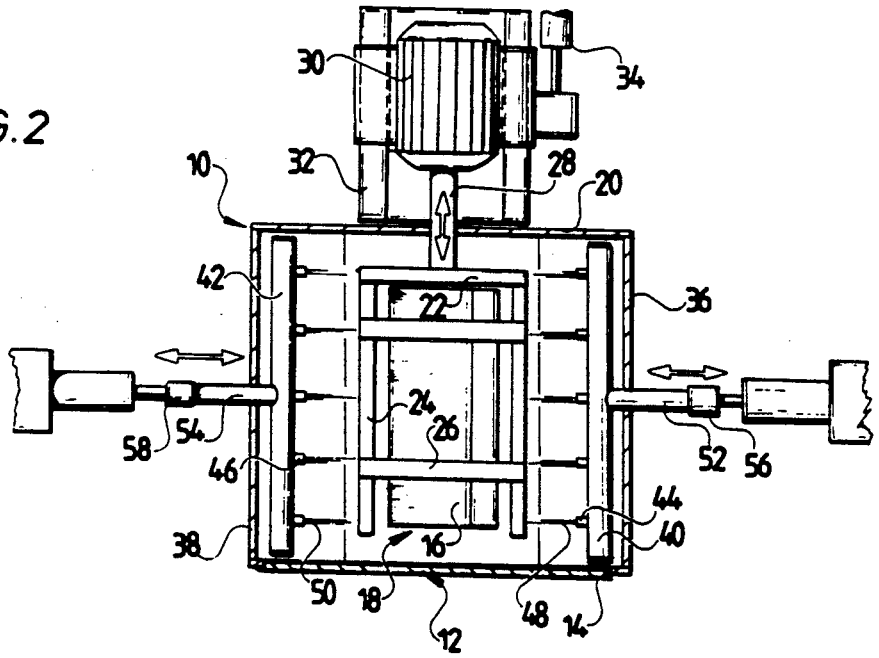
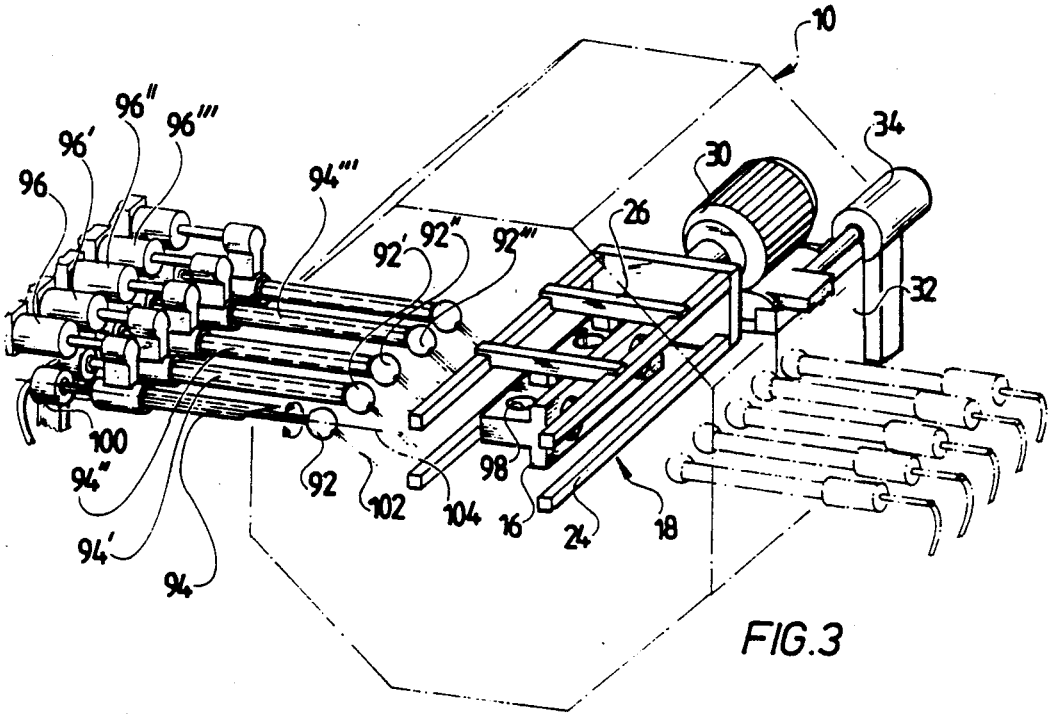
FIG. 3

FLOODWASHING PROCESS AND FLOODWASHER

The invention relates to a process for floodwashing workpieces wherein the workpiece is immersed in a bath of washing liquid and a workpiece surface is acted upon by at least one jet of washing liquid issuing from a nozzle.

The invention further relates to a floodwasher for workpieces comprising a washing chamber, a workpiece holder arranged in the washing chamber, at least one nozzle arranged in the washing chamber and directed towards a surface of the workpiece and a pumping means for supplying the nozzle with washing liquid.

A floodwashing process and a floodwasher are known from German Utility Model No. 84 37 870.0. This process is based on the idea that in order to achieve optimum cleaning, the workpiece surface immersed in the washing liquid must be acted upon by a jet at a speed which is as high as possible. Nozzles which preferably produce a jet with an inner rotation are provided for this purpose. These nozzles are preferably arranged at an inner mean distance of approximately 150 mm from the surface of the immersed workpiece facing them.

In this process it has been found that good cleaning results are only obtained if very high nozzle pressures in the range of from 8 to 20 bar are used.

The disadvantage of these high nozzle pressures is that complicated, multistage centrifugal pumps and, consequently, also high power are required to attain them. Also, the centrifugal pumps cannot be operated with unfiltered washing liquid if failure-free operation is to be guaranteed for quite a long period of time. Therefore, in addition to the power required to produce the high nozzle pressure, there is the further disadvantage that in order to maintain failure-free operation for quite a long period of time, the total flow volume must be passed through a filtering device, which involves a reduction in power and, consequently, in turn, additional power requirement.

The object underlying the invention is, therefore, to so improve a process of the generic kind that optimum cleaning efficiency of the jets is obtainable with as low pumping capacity as possible.

This object is achieved, in accordance with the invention, in a process of the kind described at the beginning by a free jet being used as jet and by the nozzle being guided at a distance from the workpiece surface which at most is approximately twice the length of the jet core of the free jet. In the context of the present invention, a free jet is to be understood as an irrotational, single, parallel jet, the jet core of which is defined as the jet region in which the speed is still identical with the speed at which the jet issues. Therefore, the length of the jet core is that distance from the nozzle up to which regions whose speed is equal to the issuing speed of the jet still exist in the jet. This jet core length is correlated with a diameter of the nozzle and is usually 5 to 7 times the nozzle diameter irrespective of the nozzle pressure.

The advantage of the inventive process is that by using an irrotational jet, the speed at which the jet strikes the surface of the workpiece in the proximity of a jet axis is approximately identical with or only slightly lower than the speed at which the jet issues from the nozzle.

The invention differs from the German Utility Model No. 84 37 870.0 in that in contrast with the prior art it requires an irrotational jet and, in addition, distances between the nozzle and the workpiece surface which are smaller than those in the German Utility Model No. 84 37 870.0.

Aside from the improvement in the cleaning, the inventive process has the further advantage that such high nozzle pressures are no longer required, which, consequently, eliminates the need for complicated, multistage centrifugal pumps with a filter connected upstream from them.

An improvement in the performance of the process is achievable by the distance between the nozzles and the workpiece surface being at most approximately 1.5 times the length of the jet core, i.e., approximately 10 times the nozzle diameter. It is, however, even better for the distance to be at most approximately equal to the length of the jet core in order that the workpiece surface is acted upon in the area of contact with the jet by washing liquid having the same speed as that at which it issues from the nozzle.

Since a flow of retained liquid occurs where the jet contacts the workpiece surface, it has proven advantageous for the distance between the nozzles and the workpiece surface to be at least 0.5 times the length of the jet core, i.e., 3 times the nozzle diameter.

Two different ways of performing the process are conceivable in order to always maintain the correct distance between a nozzle and the workpiece surface in the inventive process.

In the first variant, the nozzle and the workpiece are moved relative to each other in the direction of the jet and, therefore, the correct distance is always maintained. All possible forms of relative motion are conceivable, i.e., translatory and/or rotatory motions. In the second variant, several nozzles each with a different jet core length, i.e., a different nozzle diameter, are provided and those nozzles which are spaced at the correct distance are switched on.

In both processes, it is expedient for the nozzle and the workpiece to be moved relative to each other transversely to the direction of the jet in order to obtain even cleaning results throughout the workpiece surface. By virtue of this relative motion, in the first variant, the nozzle is readjusted in accordance with the respective shape of the workpiece surface by the relative motion in the direction of the jet, whereas in the second variant, in dependence upon the motion of the workpiece relative to the nozzles transversely to the jet direction, that nozzle is switched on which in view of the shape of the workpiece surface is at the correct distance from the workpiece surface.

Particularly with workpieces having complex shapes, it has proven advantageous for the nozzle and the workpiece to be moved at different speeds relative to each other in accordance with the workpiece surface, i.e., for example, areas of the workpiece surface which are heavily soiled or have complex shapes are made to pass the nozzles at a slower speed than smooth surfaces which are only slightly soiled.

The inventive process is, above all, also to be used to clean workpieces with cavities and holes. In order to maintain optimum spacing between nozzle and workpiece surface in the case of such parts, it has been found expedient for the nozzles to be brought up at most as far as the workpiece surface in order for the holes and cavities to be separately contacted by washing liquid.

It is, however, also conceivable for the nozzles to be briefly placed on a corresponding bore to enable the jet to fully penetrate and flush this bore.

In order to increase the tangential flow velocity on the workpiece surface, it has proven advantageous for the workpiece surface to be contacted by a jet extending at an incline to the workpiece surface. More even cleaning results are obtained if the angle between the jet and the workpiece surface is continuously, more particularly, oscillatingly altered.

With workpieces in which, for example, blind holes open into the workpiece surface, in order to achieve optimum cleaning of these blind holes or similar recesses; it has similarly proven expedient for the workpiece surface to be acted upon by a jet extending at an incline to the workpiece surface. The advantage of this jet striking the workpiece surface at an incline is that it produces an optimum surface flow also in the blind holes, which results in optimum cleaning of these.

Since this process does not necessarily require the washing liquid to be cleaned in the main flow line, the washing liquid may be cleaned in the subsidiary flow line. The consequence of this is that the total liquid is not cleaned in each cycle, but that a considerably larger number of cycles is required for this. This has the disadvantage that some contaminated washing liquid is left on the workpiece when the washing liquid is pumped off. For this reason, it is advantageous for the workpiece to be rinsed with cleaned washing liquid once the washing liquid has been pumped off.

The most effective way for this rinsing to be carried out is for the workpiece surfaces to be rinsed with cleaned washing liquid during the pumping-off operation once they are no longer in the immersed state. Finely filtered washing liquid which is substantially free from all dirt particles is used for this purpose.

A further object of the invention is to so improve a floodwasher of the generic kind that cleaning which is as effective as possible is achievable with it.

This object is accomplished, in accordance with the invention, in a floodwasher of the kind described at the beginning by the nozzle being a free-jet nozzle and by the nozzle being arranged at a distance from the surface of the workpiece which at most is approximately twice the length of the jet core of the nozzle.

For details of the advantages of the inventive floodwasher, reference is made to the advantages cited in connection with the process described above.

In the inventive floodwasher, it has, furthermore, proven advantageous for the distance of the nozzle from the workpiece surface to be at most approximately 1.5 times the length of the jet core of the nozzle, and, even better, for the distance to be at most equal to the length of the jet core.

In view of the resulting flow of retained liquid, it is not very expedient for the nozzle to be brought up too close to the surface. Therefore, it is desirable for the distance to be at least 0.5 times the length of the jet core.

To enable the above-mentioned distance to be maintained with workpieces having complex shapes, it is expedient for the nozzle and the workpiece to be movable relative to each other in the direction of a jet. This movability may have a translatory and/or a rotatory component in the case of both the nozzle and the workpiece. In accordance with the invention, these motions may be carried out both as even and as oscillating motions.

However, since it is not sufficient for the nozzle to always be held at the optimum distance from the workpiece surface, but in order to achieve even cleaning of the total workpiece surface, the total workpiece surface should be able to be contacted by a jet from a nozzle arranged at the correct distance, it is expedient for the nozzle and the workpiece to be movable relative to each other transversely to the direction of the jet. In this case, too, translatory and/or rotatory motions, preferably as even or oscillating motions, are conceivable.

To enable cleaning of the workpiece to be carried out as quickly as possible, it has proven expedient for several nozzles to be provided.

There are basically two possible ways of arranging these nozzles. In a first embodiment, it is conceivable for several nozzles which all have the same jet core length, i.e., the same diameter, to be arranged on nozzle pipes. In this case, the nozzle pipes themselves are to be arranged for displacement relative to the workpiece surface in order to always maintain the optimum spacing from the workpiece surface.

It is, however, also conceivable for several nozzles with a different jet core length to be provided. In this case, during the relative motion of the workpiece surface transversely to the direction of the jet, that nozzle which is at the optimum distance from the workpiece surface at that particular time is always switched on.

In particular, in the last embodiment, it is also conceivable for several nozzles with the same jet core length to be provided. In this case, it is expedient for the nozzles with the same jet core length to be jointly activatable.

It similarly lies within the scope of the present invention for the nozzles to be displaceable relative to the workpiece surface in the jet direction towards the workpiece surface and, at the same time, to have different jet core lengths and, in addition, to be activatable in dependence upon the given distance from the workpiece surface.

In a further advantageous embodiment of the inventive washer, the nozzles are arranged in staggered relationship to one another and hence form a nozzle pattern which enables area-wise contacting of the surface of the workpiece. In this case, however, in spite of this area-wise contacting of the workpiece surface, it is advantageous for relative motion to take place between the nozzles and the workpiece surface in order that those areas of the workpiece surface lying in zones of retained liquid can be transferred to zones with a strong incident flow and vice versa, thereby to achieve even cleaning results on the workpiece surface.

It has, furthermore, proven expedient for the staggered nozzles to be spaced equidistantly in the transverse direction relative to each other so that the nozzles lie in the corners of isosceles triangles.

As a supplement to this configuration, it is advantageous for the spacing in the transverse direction to be approximately equal to the distance between the nozzles and the workpiece surface. In this case, optimum area-wise jet contact with the workpiece surface is possible.

In order to prevent washing liquid from dripping from the nozzles and from reaching the workpiece surface when the washing liquid is removed, it is expedient for the nozzles to be arranged at the sides of the workpiece.

In all embodiments in which different nozzles are used, it has proven expedient, in order to make optimum use of the pumping capacity, for the total effective nozzle area activated in each case, i.e., the sum of the cross-sections of all of the nozzles which are switched on, to always be approximately the same.

It has been explained above that within the scope of the present invention, motion of the workpiece relative to the nozzles is extremely advantageous. It has, however, not been indicated how such relative motion is to be achieved. In the structurally simplest solution, the workpiece holder is rotatable.

In the case where a workpiece rotates in the washing chamber, it has proven expedient for the jets to issue with a tangential component in relation to an axis of rotation of the workpiece in order to induce a vortex-type flow in the washing chamber. This advantageously contributes towards increasing the tangential flow on the workpiece surface and, consequently, towards improving the cleaning efficiency.

It has, furthermore, proven advantageous, particularly in the cleaning of small workpieces, for adjustable flow deflector plates to be provided to intensify a vortex-type flow around the axis of rotation of the workpiece.

As mentioned above in conjunction with the inventive process, in the present invention it is no longer necessary for the pumping means to have a filter system which operates in the main flow line and disadvantageously affects the pumping capacity because multistage centrifugal pumps are no longer required. For this reason, it has proven expedient, within the scope of the present invention, for the pumping means to comprise a circulating pump operating in the main flow line and a filter system operating in the subsidiary flow line so the pumping efficiency is no longer adversely affected by the filter system and the filter system can be operated independently of the main flow line in accordance with the respective degree of contamination of the washing liquid.

In order to make the filter system completely self-sufficient and, if required, to enable a final washing of the workpieces to be carried out after the washing liquid has been pumped off, it is advantageous for the filter system to be provided with a separate pump. In this case, and in the case where there is jet contact with the workpiece in the main flow line, complicated devices which are otherwise required for maintaining the necessary liquid level in the immersion bath can be dispensed with as the pump operating in the main flow line always aspirates exactly that flow volume from the immersion bath which is fed to the bath again by the jets.

Figure 4:
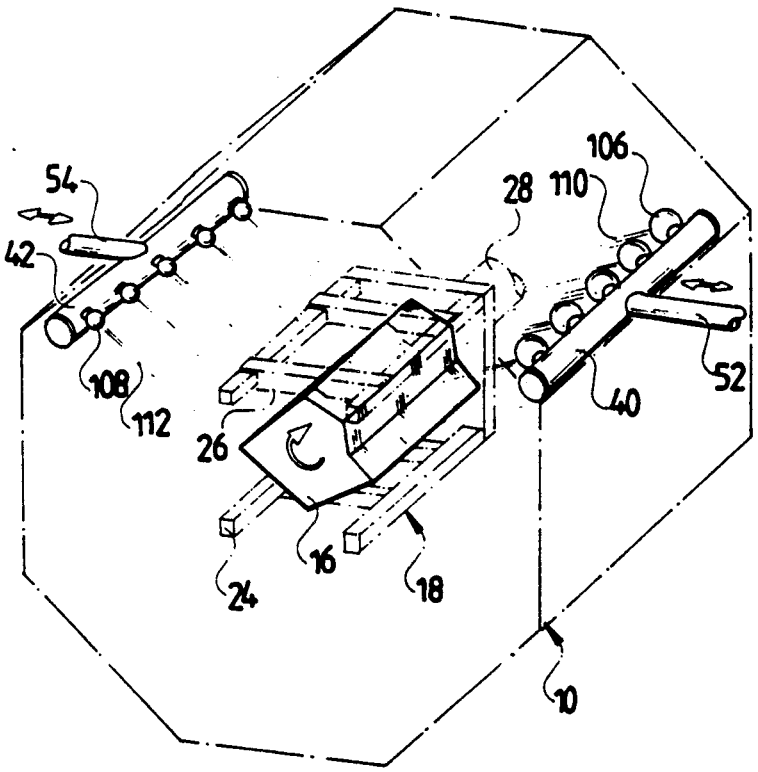

Further features and advantages of the invention are to be found in the following description and the accompanying drawings of several embodiments. The drawings show:

FIG. 1 a schematic, partially broken-open illustration of a first embodiment of the inventive floodwasher;

FIG. 2 a section taken along line 2—2 in FIG. 1;

FIG. 3 a second embodiment similar to FIG. 1;

FIG. 4 a third embodiment similar to FIG. 1; and

Figure 5:
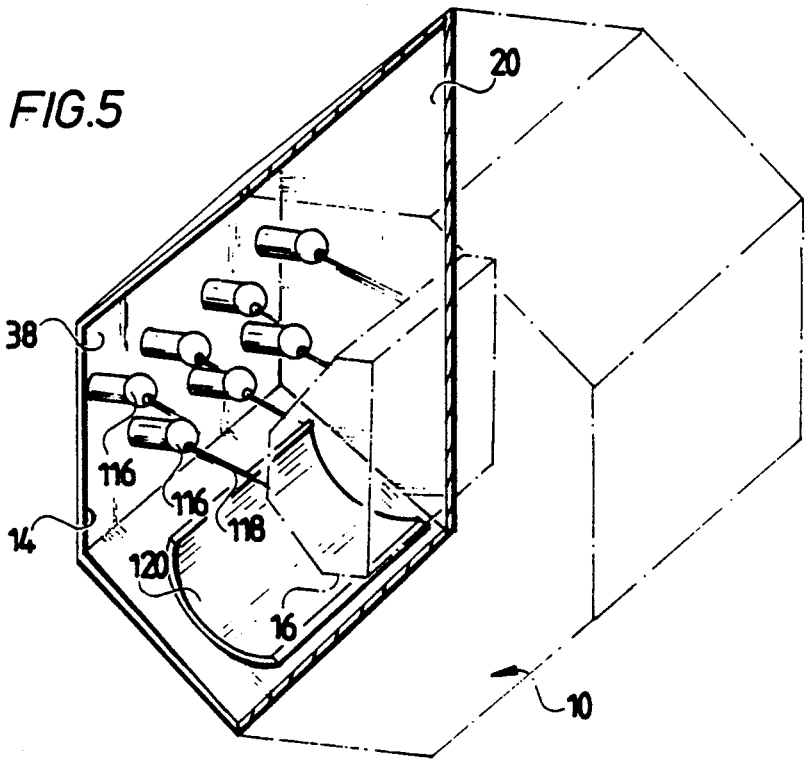

FIG. 5 a fourth embodiment similar to FIG. 1.

A first embodiment of the inventive floodwasher is shown in detail in FIGS. 1 and 2.

This floodwasher comprises a floodwashing chamber 10 of, for example, hexagonal cross-section into which a workpiece 16 to be cleaned can be introduced through a front opening 14 which is closable by a door 12.

This workpiece 16 is held in a workpiece holder 18 inside the floodwashing chamber 10. The workpiece holder 18 has a rectangular holding plate 22 arranged parallel to a rear wall 20 opposite the front opening 14 in the floodwashing chamber 10. Four holding arms 24 extend from the corners of the holding plate 22 in the longitudinal direction of the floodwashing chamber 10 towards the front opening 14. The workpiece 16 is fixed on the four holding arms by, for example, holding bars 26.

The complete workpiece holder 18 is, in turn, held by a shaft 28 which is arranged centrally in relation to the holding plate 22 and extends from it through the rear wall 20. The shaft 28 is rotatable by a drive motor 30 and so the complete workpiece holder 18 is arranged for rotation inside the floodwashing chamber 10. In addition, the drive motor 30 itself is held on guides 32 extending parallel to the shaft 28. The drive motor 30 is displaceable on these guides 32 parallel to the longitudinal direction of the shaft 28 by a shifting device 34. Therefore, the workpiece holder 18 is not only rotatable in the floodwashing chamber 10 but also slidingly displaceable in its longitudinal direction.

Nozzle pipes 40 and 42 provided with nozzles 44 and 46 on their sides facing the workpiece 16 or the workpiece holder 18 are held on either side of the workpiece holder 18, for example, in the region of vertical wall surfaces 36 and 38 in the floodwashing chamber 10.

These nozzles 44 and 46 are free jet nozzles, i.e., nozzles which produce a jet 48 and 50, respectively, with an approximately parallel and straight orientation.

Particularly in washers for workpieces with holes and quite large, continuous openings, the nozzle pipes 40 and 42 are vertically offset in relation to each other so that areas of retained water with a reduced flow velocity are not formed in the workpiece by jets oriented approximately coaxially against one another.

The nozzle pipes 40 and 42 each have an inflow pipe 52 and 54, respectively, which leads from the interior of the floodwashing chamber 10 to the outside through the side wall 36 and 38, respectively.

Each of these inflow pipes 52 and 54 is held on a displacement device 56 and 58, respectively. This, therefore, enables displacement of the nozzle pipes inside the floodwashing chamber 10 by means of the inflow pipes 52 and 54, respectively.

The ends of the inflow pipes 52 and 54 remote from the nozzle pipes 40 and 42, respectively, are connected through hoses 60 and 62, respectively, to a discharge end of a pump 64 which communicates at the intake end through a suction pipe 66 with an outflow opening 68 of the floodwashing chamber 10. A filter system 70 which is operated in a subsidiary flow line and comprises a filter 72 with a filter pump 74 connected downstream from it branches off from the suction pipe 66. The discharge end of the filter pump 74 is connectable either with the intake end of the pump 64 or directly with the hoses 60 and 62 by a valve 76 arranged at the discharge end of the filter pump 74.

A liquid reservoir 78 is fillable by a shift valve 80 arranged between the discharge end of the pump 64 and the connection of the hoses 60 and 62. This reservoir 78 is connected through an outflow pipe 82 to a shift valve 84 arranged in the suction pipe 66 and so the reservoir 78 can be emptied by means of the pump 64.

The first embodiment operates in the following way: The door 12 is opened and the workpiece 16 is placed in the workpiece holder 18. The door 12 is then closed and the interior of the floodwashing chamber 10 is flooded by washing liquid being made to flow by corresponding adjustment of the shift valve 84 from the reservoir 78 through the pump 64 and being sprayed, for example, through nozzles 44 and 46 onto the workpiece 16.

The actual washing operation does not begin until the floodwashing chamber has been filled to the extent that the workpiece 16 is completely immersed in the washing liquid. In this case, the shift valve 84 is adjusted so as to enable the pump 64 to aspirate washing liquid from the outflow opening 68 through the suction pipe 66 and deliver it to the inflow pipes 52 and 54 through the hoses 60 and 62, respectively. From there, the washing liquid is distributed in the nozzle pipes 40 and 42 and acts upon the workpiece 16 through the nozzles 44 and 46 which are immersed in the bath of washing liquid. The displacement devices 56 and 58 are displaced by a control system 90 in dependence upon the rotation of the workpiece 16 by the drive motor 30 either towards the workpiece 16 or away from it so that the distance between a workpiece surface and the nozzles 44 and 46 corresponds approximately to the length of the jet core of the jets 48 and 50. In this way, these jets 48 and 50 strike the workpiece surface at the maximum possible speed, which results in the best possible cleaning.

It is also possible for the complete workpiece holder 18 and hence the workpiece 16 to be moved by the shifting device 34 in the longitudinal direction of the floodwashing chamber 10, i.e., parallel to the shaft 28, thereby to ensure that the areas of the workpiece surface lying between the nozzles 44, 46 are likewise contacted by the jets 48 and 50, and, consequently, that the workpiece surface is acted upon in its entirety during the complete washing operation.

Since advantageous cleaning results are also obtained at a spacing of between 0.5 times the length of the jet core and 1.5 times the length of the jet core, it is not necessary for the control system 90 to make the nozzle pipes 40 and 42 follow an outer contour of the workpiece 16 precisely. It is adequate for the nozzle pipes 40 to maintain the above-mentioned distance range between the workpiece surface and the nozzles 44 and 46.

During the washing operation, washing liquid is simultaneously removed from the suction pipe 66 in the subsidiary flow line and passed through the filter system 70 where continuous cleaning of the washing liquid takes place. This filtered washing liquid is then fed to the intake end of the pump 64 by corresponding adjustment of the valve 76.

After completion of the washing operation, the shift valve 80 is adjusted so that the pump 64 no longer feeds the washing liquid to the hoses 60 and 62, but instead only to the reservoir 78, with the result that a liquid level 93 of the washing liquid drops little by little inside the floodwashing chamber 10 and the workpiece 16 emerges from the washing liquid. By adjustment of valve 76, filtered washing liquid can now be fed through the filter pump 74 to the nozzles 44 and 46 which spray the filtered washing liquid onto the emerged area of the workpiece 16 and thereby finally rinse the workpiece 16.

If, however, nozzles 44 and 46 are unsuitable for this purpose, owing, for example, to the low pumping capacity of the filter pump 74, additional washing nozzles are arranged, in accordance with the invention, for example, above the workpiece 16. The filter pump 74 then supplies these wash nozzles with filtered washing liquid for the final rinsing of the workpiece 16.

Insofar as a second embodiment shown in FIG. 3 has the same parts as the first embodiment, it bears the same reference numerals. Therefore, for a description of these parts, reference is made to the description of the first embodiment.

In contrast with the first embodiment, the nozzles 92, 92', 92'', 92''' are not held on a common nozzle pipe, but instead have their own inflow pipe 94, 94', 94'', 94''', and each of these flow pipes 94 to 94''' has its own displacement device 96, 96', 96'', 96'''. It is, therefore, possible, in particular, with workpieces 16 with surface shapes which vary in the longitudinal direction of the workpiece, to displace the nozzles 92 to 92''' individually towards the workpiece 16 in order to maintain the optimum spacing between the workpiece surface and the respective nozzle 92 to 92'''.

As in the first embodiment, the respective shape of the workpiece 16 is then entered into the control system 90 to enable it to activate nozzles 92 to 92''' in accordance with the rotary position of the workpiece holder 18. In this way, it is, for example, also possible for one or several holes 98 in the workpiece to be efficiently cleaned by one of the nozzles 92 to 92''' being made to approach the hole 98 as it passes this nozzle during the rotary motion and, consequently, the optimum spacing between the respective nozzle 92 to 92''' and the workpiece surface is also maintained with respect to the workpiece surface within the hole 98.

In a modification of the second embodiment, the nozzles 92 to 92''' are provided with an additional rotary device 100 which permits rotation of the nozzles 92 to 92''' as a whole, in addition to displacement, and so the hole 98 can be cleaned even more effectively. In this case, the jet 102 then preferably includes an angle with an axis of rotation 104.

If the second embodiment is of such design, it is then possible, for example, in the case where the hole 98 comes to rest in front of one of the nozzles 92 to 92''', for the rotary motion to be stopped, the respective nozzle 92 to 92''' to be moved towards the hole 98 until optimum spacing is attained, and for the nozzle to then be rotated to enable all of the wall areas of the hole 98 to be contacted.

Insofar as a third embodiment of the inventive washer illustrated in FIG. 4 is identical with the embodiments described above, it bears the same reference numerals.

In contrast with the embodiments described above, this third embodiment has two firmly installed sets of nozzles 106 and 108 which do, however, have a differently sized nozzle diameter. Since the nozzle diameter is proportional to the length of the core of the jet which is approximately 5 to 7 times the nozzle diameter, the jets 110 and 112, consequently, also have a different jet core length.

Unlike the embodiments described above, the nozzles 106 and 108 in this embodiment do not need to be moved. Instead, in dependence upon the rotary motion of the workpiece 16, that set of nozzles 106 or 108 whose nozzles 106 and 108, respectively, are at the optimum distance, i.e., for example, a distance of 3 to 10 nozzle diameters, from the workpiece surface, is always switched on. If the workpiece surface no longer lies within this distance range during rotation, the respective set of nozzles is switched off in order to save pumping power.

In accordance with the invention, not two sets of nozzles 106, 108 only, but a plurality of sets with different nozzle diameters may be used in this embodiment. In this case, the control system 90 then activates in dependence upon the rotary motion of the workpiece 16 that nozzle set whose nozzles are at the optimum distance from the workpiece surface.

In a fourth embodiment illustrated in FIG. 5, two rows of staggered nozzles 116 are arranged on both vertical walls 36 and 38 of the floodwashing chamber 10. The distances between the nozzles 116 are identical and so three nozzles together form an isosceles triangle. These spacings between the nozzles are preferably selected so as to correspond approximately to a spacing between these nozzles and the workpiece surface.

In the washing operation, all of the nozzles 116 are switched on simultaneously, which enables the workpiece to be contacted area-wise by jets 118 and hence area-wise cleaning to be carried out on the workpiece. In order for the cleaning to be as even as possible throughout the entire surface acted upon, it is important in this embodiment for the workpiece 16 to be movable back and forth in the longitudinal direction of the floodwashing chamber 10. This is made possible by, for example, displacement of the drive motor 30 by the shifting device 34, which enables the zones of collected washing liquid between the areas contacted by the individual jets 118 where there is no effective cleaning action to shift over the workpiece surface and, therefore, each part of the workpiece surface lies at one stage in a zone where the cleaning action is effective.

In this embodiment, too, it is possible for the staggered nozzles 116 to be mounted on a support and hence arranged for displacement relative to the workpiece 16. It is, however, also possible to provide different sets of staggered nozzles with different diameters so that that set of staggered nozzles with that diameter which is at the optimum distance from the workpiece surface is switched on.

In addition, the fourth embodiment, for example, may include flow deflector plates 120 arranged tangentially in relation to an axis of rotation of the workpiece 16 to produce a vortex-type flow around the workpiece 16.

The present disclosure relates to the subject matter disclosed in German Application No. P 37 31 410.6 of Sept. 18, 1987, the entire specification of which is incorporated herein by reference.

We claim:

1. A process for floodwashing a workpiece, comprising the steps of:

(1) immersing said workpiece in a bath of washing liquid;

(2) acting on a surface of said workpiece with at least one free jet of washing liquid issuing from a nozzle arranged in said bath extending in said bath to said surface; and (3) keeping said nozzle at a washing distance from said workpiece surface which is at most approximately twice the length of a jet core of said free jet.

2. Process as defined in claim 1, characterized in that the distance is at most approximately 1.5 times the length of the jet core.

3. Process as defined in claim 2, characterized in that the distance is at most approximately equal to the length of the jet core.

4. Process as defined in claim 1, characterized in that the distance is at least approximately 0.6 times the length of the jet core.

5. A process as defined in claim 1 wherein the nozzle and the workpiece are moved in a direction of movement relative to each other which is parallel to the direction of the jet.

6. A process as defined in claim 1 wherein more than one nozzle is provided and only those nozzles which are spaced at the washing distance are switched on.

7. Process as defined in claim 1, characterized in that the nozzle and the workpiece are moved relative to each other transversely to the direction of the jet.

8. Process as defined in claim 1, characterized in that the nozzle and the workpiece are moved at different speeds relative to each other in accordance with the workpiece surface.

9. Process as defined in claim 1, characterized in that the nozzles are brought up at most as far as the workpiece surface.

10. Process as defined in claim 1, characterized in that the workpiece surface is contacted by a jet extending at an incline to the workpiece surface.

11. Process as defined in claim 10, characterized in that the angle between the jet and the workpiece surface is less than 45 degrees.

12. Process as defined in claim 11, characterized in that the angle between the jet and the workpiece surface is less than 30 degrees.

13. Process as defined in claim 10, characterized in that the angle between the jet and the workpiece surface is constantly changed between two extreme values.

14. Process as defined in claim 13, characterized in that the angle oscillates between the extreme values.

15. Process as defined in claim 1, characterized in that after the washing liquid has been pumped off, the workpiece is rinsed with cleaned washing liquid.

16. Process as defined in claim 15, characterized in that during the pumping-off operation, the workpiece surfaces which are no longer immersed are rinsed with filtered washing liquid.

17. A floodwasher for workpieces, comprising:

a washing chamber enclosing a bath of washing liquid;

a workpiece holder arranged in said washing chamber for holding a workpiece immersed in said bath;

a free-jet nozzle arranged in said washing chamber and immersed in said bath;

a free jet of washing liquid ejected from said nozzle and directed towards a surface of said workpiece, said nozzle being arranged at a washing distance from said surface which is at most approximately twice the length of a jet core of said free jet; and a pumping means for supplying said nozzle with said washing liquid to be ejected.

18. Floodwasher as defined in claim 17, characterized in that the distance is at most approximately 1.5 times the length of the jet core of the nozzle.

19. Floodwasher as defined in claim 18, characterized in that the distance is at most approximately equal to the length of the jet core.

20. Floodwasher as defined in claim 17, characterized in that the distance is at least approximately 0.5 times the length of the jet core.

21. Floodwasher as defined in claim 17, characterized in that the nozzle and the workpiece are movable relative to each other in the direction of a jet.

22. Floodwasher as defined in claim 17 characterized in that the nozzle and the workpiece are movable relative to each other transversely to the direction of the jet.

23. Floodwasher as defined in claim 17, characterized in that several nozzles are provided.

24. Floodwasher as defined in claim 23, characterized in that several nozzles arranged on nozzle pipes are provided.

25. Floodwasher as defined in claim 23, characterized in that several nozzles with a different jet core length are provided.

26. Floodwasher as defined in claim 25, characterized in that the nozzles with an identical jet core length can be switched on jointly.

27. Floodwasher as defined in claim 23, characterized in that the nozzles are arranged in staggered relationship to each other.

28. Floodwasher as defined in claim 27, characterized in that the nozzles are spaced equidistantly from one another in the transverse direction.

29. Floodwasher as defined in claim 28, characterized in that the spacing in the transverse direction is approximately equal to the distance between the nozzles and the surface of the workpiece.

30. Floodwasher as defined in claim 19, characterized in that the nozzles are arranged at the sides of the workpiece.

31. Floodwasher as defined in claim 17, characterized in that the workpiece holder is rotatable.

32. Floodwasher as defined in claim 31, characterized in that a vortex-type flow can be induced in the washing chamber by arrangement of the nozzles with a tangential component in relation to an axis of rotation of the workpiece.

33. Floodwasher as defined in claim 32, characterized in that flow deflector plates are provided for producing a vortex-type flow around the axis of rotation of the workpiece.

34. Floodwasher as defined in claim 33, characterized in that the flow deflector plates are adjustable.

35. Floodwasher as defined in claim 17, characterized in that the pumping means comprises a circulating pump operating in the main flow line and a filter system operating in the subsidiary flow line.

36. Floodwasher as defined in claim 35, characterized in that the filter system has a separate pump.

* * * * *